US005292709A

United States Patent [19]

Sakamoto

[11] Patent Number: 5,292,709

[45] Date of Patent: Mar. 8, 1994

[54] METHOD FOR ADHERING THERMOSENSITIVE TRANSFER FILM TO BE USED FOR COLOR PRINTING

[75] Inventor: Kenji Sakamoto, Tokyo, Japan

[73] Assignee: Dai Nippon Printing Co., Ltd., Tokyo, Japan

[21] Appl. No.: 888,922

[22] Filed: May 27, 1992

[30] Foreign Application Priority Data

May 27, 1991 [JP] Japan ..... 3-121259

[51] Int. Cl.[5] ..... B41M 5/035; B41M 5/38

[52] U.S. Cl. ..... 503/227; 83/948; 156/94; 156/98; 156/159; 156/304.1; 156/304.5; 400/197; 400/200; 428/58; 428/195; 428/913; 428/914

[58] Field of Search ..... 156/94, 98, 304.5, 159, 156/304.1; 400/197, 200; 428/58, 195, 913, 914; 503/227; 8/471; 83/948

[56] References Cited

U.S. PATENT DOCUMENTS 5,018,419 5/1991 Omura ..... 83/451

*Primary Examiner*—B. Hamilton Hess

*Attorney, Agent, or Firm*—Wenderoth, Lind & Ponack

[57] ABSTRACT

A method for of connects cut edges of a thermosensitive transfer film having a plurality of color frame units each comprising at least a yellow frame, a magenta frame and a cyan frame arranged in a straight line in the order of the yellow frame, the magenta frame, and the cyan frame where a frame includes a defective part. Each frame has a transfer starting mark. The method includes the steps of cutting the film at a position of the yellow frame precedent to the magenta frame so that the transfer starting mark of the yellow frame is broken, cutting the film at a position rearward of the cyan frame and forward of the transfer starting mark of a succeeding yellow frame so as to remove the magenta and cyan frames from the film, and connecting both cut edges of the film with each other with the transfer starting mark of the yellow frame precedent to the magenta frame maintained.

14 Claims, 3 Drawing Sheets

METHOD FOR ADHERING THERMOSENSITIVE TRANSFER FILM TO BE USED FOR COLOR PRINTING

BACKGROUND OF THE INVENTION

Field of the Invention

The present invention generally relates to a method or connecting the edges of two cut parts of a thermal transfer film to be used in carrying out color printing, and particularly relates to a method for adhering a precedent part and a succeeding part thereof with each other after defective regions are removed therefrom.

Description of the Related Arts

In recent years, color video printers have been put into practical use. A thermosensitive transfer film is used to perform color printing in the color video printer. The film is rolled and accommodated in a cartridge 2 as shown in FIG. 1. The printer comprises a film-feeding roll disposed on the right side of FIG. 1; a film-winding roll disposed on the left side of FIG. 1; a thermosensitive head 3; a platen drum 4; and recording paper 5 wound around the platen drum 4.

The film 1 comprises a plurality of color frame units U(U0, U1, U2 . . . ), for example, 100 units or 1,000 units arranged in a line as shown in FIG. 2. Each color frame unit U has four color frames. That is, a yellow color frame (Y), a magenta color frame (M), a cyan color frame (C), and a black color frame (B) are arranged along the direction shown by an arrow in which the film 1 progresses. The three color frames (Y), (M) and (C) are essential for printing, while the black color frame (B) may be omitted. The arrangement order of the color frames of (Y), (M), (C) and (B) is optimum for obtaining a preferable tone. That is, first the image of the yellow color frame (Y) is thermally transferred to the recording paper 5; secondly, the image of the magenta color frame (M) is thermally transferred thereto; thirdly, the image of the cyan color frame (C) is thermally transferred thereto; and finally, the image of the black color frame (B) is thermally transferred thereto. Thus, the printing of one image plane is accomplished.

If the film 1 becomes defective at a portion 7 of the film 1, for example, on cyan color frame (C) of a color frame unit U1 as shown in FIG. 2, one rolled film is discarded. It is uneconomical, however, to discard the entire rolled film due to a partial defect thereof.

SUMMARY OF THE INVENTION

It is an essential object of the present invention to provide a method of connecting the cut edge of a precedent part of a thermosensitive transfer film and that of a succeeding part thereof with each other by removing only a defective region therefrom without preventing a printer from performing its function.

In accomplishing this and other objects of the present invention, according to a first embodiment of the present invention, there is provided a method of connecting cut edges of a thermosensitive transfer film having a plurality of color frame units each comprising at least a yellow frame, a magenta frame and a cyan frame arranged in a straight line in the order of the yellow frame, the magenta frame, and the cyan frame, each frame having a transfer starting mark, with any of the frames being defective, comprising the steps of:

cutting the film at a position of a faultless frame precedent to a defective frame so that the transfer starting mark of the faultless frame is broken;

cutting said film at a position rearward of said defective frame and forward of the transfer starting mark of a succeeding color frame having the same color as the faultless frame so as to remove said defective frame from the film; and connecting both cut edges of the film with each other with the transfer starting mark of the succeeding color frame maintained.

Further, according to a second embodiment of the present invention, there is provided a method of connecting both cut edges of a thermosensitive transfer film having a plurality of color frame units each comprising at least a yellow frame, a magenta frame and a cyan frame arranged in a straight line in the order of the yellow frame, the magenta frame, and the cyan frame any of frames being defective. Transfer starting marks are provided in a transfer ineffective region forward of a transfer effective region in the yellow frame of each color frame unit. The method comprises, the steps of:

cutting the film in a transfer ineffective region forward or rearward of the transfer effective region of a faultless frame precedent to the defective frame of the color frame unit;

cutting the film in a transfer ineffective region rearward of an effective region of a color frame having the same color as the last color frame of the precedent part of the film cut in the previous step so as to remove the defective frame from the film;

connecting both cut edges of the film with each other; and covering a precedent transfer starting mark with an adhering tape if two transfer starting marks are adjacent to each other so as to break the precedent transfer starting mark.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
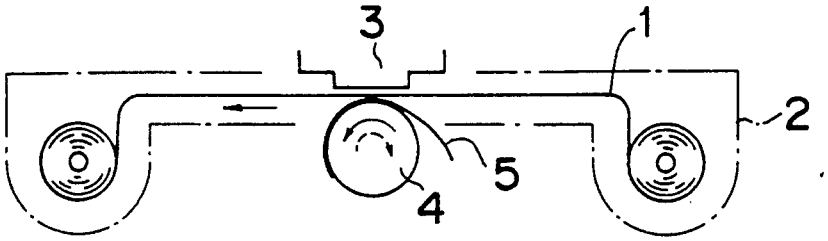
Fig. 1 PRIOR ART
FIG. 1 is an explanatory view showing a cartridge, i.e. type thermosensitive transfer film to be used in color printing.

Before the description of the present invention proceeds, it is to be noted that like parts are designated by like reference numerals throughout the accompanying drawings.

A first embodiment of the present invention is described below with reference to FIGS. 3, 4, and 5.

Figure 2:
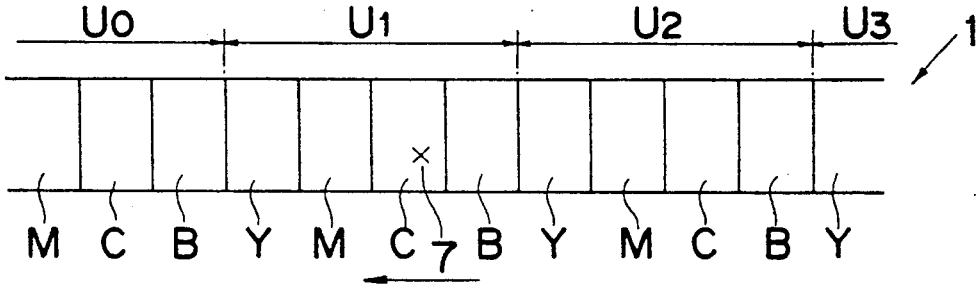
Fig. 2 PRIOR ART
FIG. 2 is a plan view showing color frames of the film of FIG. 1.
Figure 3:
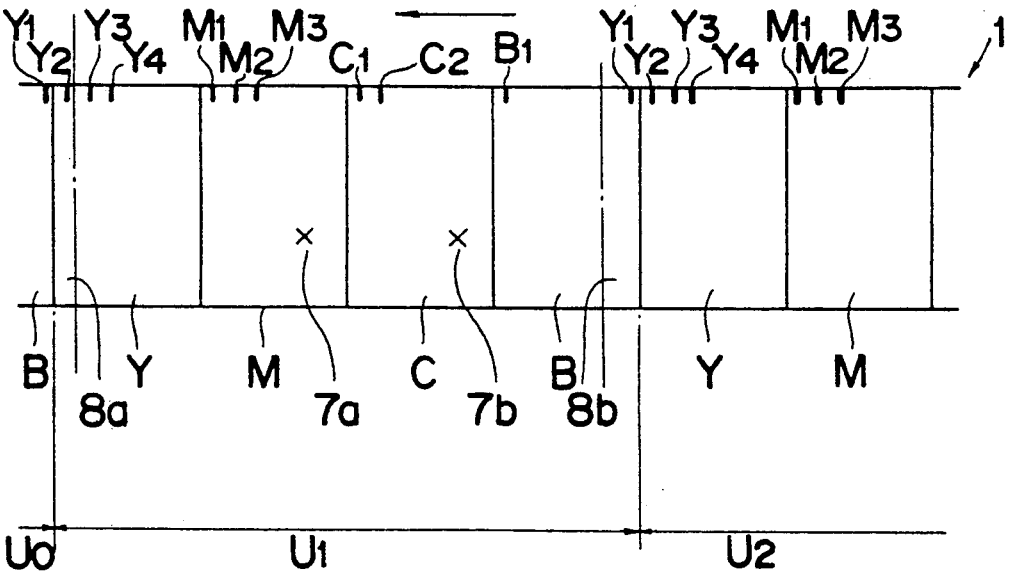
FIG. 3 is a plan view showing the cutting process to be carried out to connect the cut edge of a precedent part of a film and that of a succeeding part thereof with each other according to a first embodiment of the present invention.

Similarly to the conventional thermal transfer film to be used for color printing described previously with reference to FIGS. 1 and 2, a thermal transfer film 1 according to the embodiment comprises a plurality of color frame units U(U0, U1, U2, . . . ) arranged in a line as shown in FIG. 3. Each color frame unit (U) has four color frames. That is, a yellow color frame (Y), a magenta color frame (M), a cyan color frame (C), and a black color frame (B) are arranged along the direction indicated by a arrow in which the film 1 progresses. The three color frames (Y), (M), and (C) are essential, while the black color frame (B) may be omitted, as described previously.

As shown in FIG. 3, each color frame (Y), (M), (C), and (B) has marks Y1 through Y4, M1 through M3, C1 and C2, and B1, respectively provided at a predetermined position in the vicinity of the leading end thereof. These marks are read by a detecting means of a printer. These marks indicate various information, for example, the transfer starting position of each color frame, the size of each color frame or the kind of ink applied to the film. According to the embodiment, these marks indicate at least the transfer starting position of each color frame. Thus, these marks are hereinafter referred to as transfer starting marks. According to this embodiment, the transfer starting mark of each color frame (B), (C), (M), and (Y) is composed of one, two, three, and four stripes, respectively.

Normally, the film 1 becomes defective in a plurality of color frame units. However, in this embodiment let it be supposed that the magenta frame (M) and the cyan frame (C) of the unit U1 become defective at portions 7*a* and 7*b*, respectively. The method of removing the defective portions and connecting cut edges of the film will be described below.

According to the embodiment, in the first process, the film 1 is cut in a color frame precedent to the defective color frame (M), namely, in the yellow color frame (Y). More specifically, the film 1 is cut at a desired position between the mark Y1 and Y4 as shown by one-dot chain line in FIG. 3. Thus, the mark Y1 through Y4 is broken. In this example, the transfer starting mark comprising the marks of Y1 through Y4 is broken by cutting between the mark Y2 and the mark Y3.

In the second process, the film 1 is cut in a color frame succeeding the defective color frame (C), namely, in the black color frame (B) of the unit U1 as shown by one-dot chain line in FIG. 3. More specifically, the rearward cutting line is disposed in the color frame precedent to the yellow color frame (Y) of the unit U2. Thus, the mark of Y1 through Y4 can be maintained.

The region between cutting edges 8*a* and 8*b* is removed from the film 1.

After the defective color frames (M) and (C) are removed from the film 1, both cutting edges 8*a* and 8*b* are connected with each other with the transfer starting mark of Y1 through Y4 of the unit U2 maintained.

Figure 4:
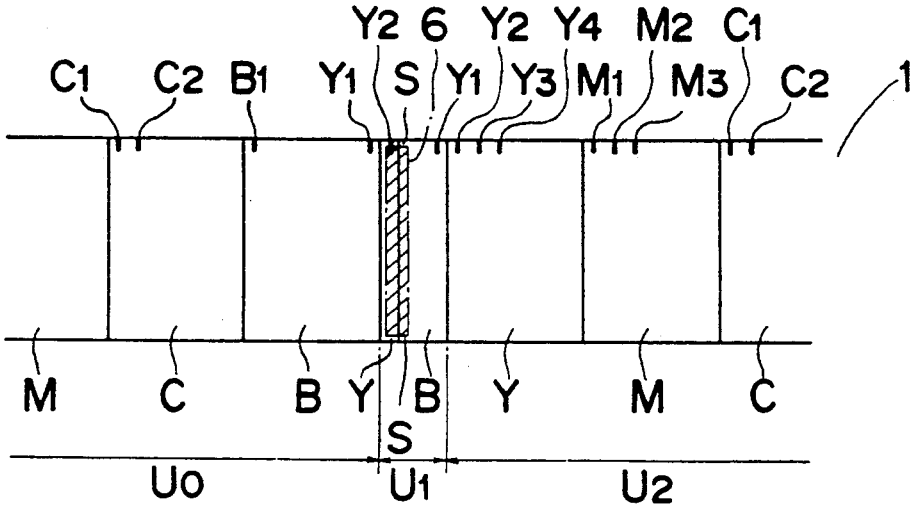
FIG. 4 is a plan view showing the process of connecting the edges of the cut film of FIG. 3 with each other.
Figure 5:
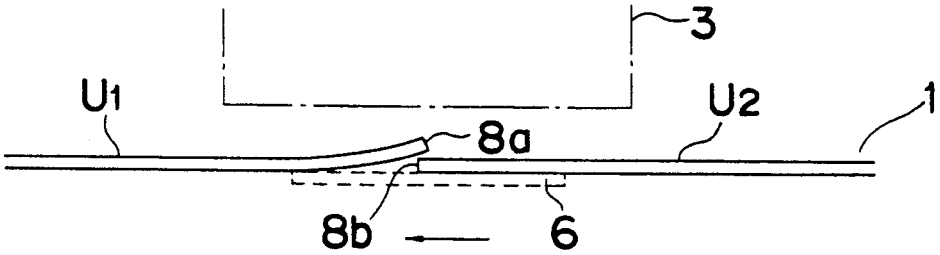
FIG. 5 is an enlarged side elevation showing portion, of the film of FIG. 4, to be adhered with each other.

It is preferable that an adhering tape 6 is used as shown in FIGS. 4 and 5. That is, preferably, the adhering tape 6 is adhered to the ink-applied surface of the film 1, namely, the surface opposed to the thermosensitive head 3. As shown in FIG. 5, it is preferable that the adhering tape 6 is adhered with the film 1 with the cutting edge 8*a* of the precedent unit U1 of the film 1 placed on the cutting edge 8*b* of the following unit U2. Thus, the cutting edge 8*a* can be prevented from being caught by the thermosensitive head 3 while the film 1 is advancing in contact with the thermosensitive head 3. As shown in FIG. 4, it is preferable that the adhering tape 6 is adhered to the film 1 so that a slight gap (S) is formed in the width direction of the film 1 between both edges of the adhering tape and the film 1. Thus, even though the adhering agent of the adhering tape spreads widthwise from both edges of the adhering tape 6, the adhering agent can be prevented from spreading in the width direction of the film 1 over the surface of the adhering tape 6 opposed to the thermosensitive head 3.

In the film 1 which has been edge-connected by the above-described method, the magenta frame (M), the cyan frame (C), the black frame (B), and the edge-connected frame are arranged sequentially as shown in FIG. 4. The edge-connected frame is composed of a part of the yellow frame (Y) and a part of the black frame (B). Accordingly, the edge-connected frame has two marks Y1 and Y2 in the vicinity of the leading end thereof. The cyan frame (C) has also two marks C1 and C2. In order to prevent the edge-connected frame from being recognized as the cyan frame (C), the detecting device of the printer stores the arrangement order of the marks (Y1 through Y4), (M1, M2, and M3), (C1 and C2), and (B1). Thus, when the detecting device detects the mark consisting of the marks Y1 and Y2 corresponding to or coinciding with the mark consisting of the marks C1 and C2, subsequently to the mark B1 as shown in FIG. 4, the detecting means does not read the mark Y1 and Y2 of the edge-connected frame but the mark of Y1 through Y4 subsequently to the mark B1.

According to the above-described cutting/connecting method, even though the film becomes defective at a certain portion, it is unnecessary to discard the entire rolled film. When the edge-connected frame is applied to the printer, it is only necessary to feed the film a very small distance without preventing the printer from performing its function.

Figure 7:
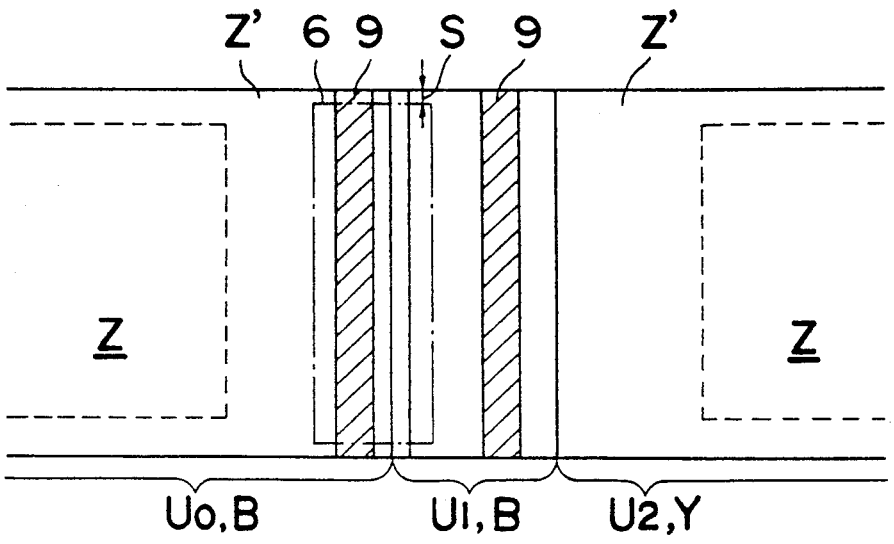
FIG. 7 is a plan view showing the process of connecting the edges of the cut film of FIG. 6 with each other.
Figure 8:
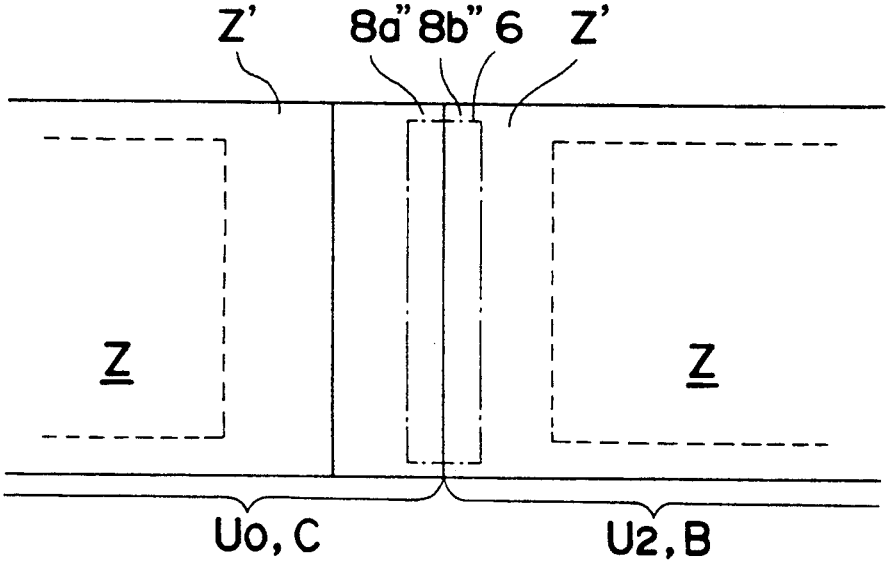
FIG. 8 is a plan view showing a process of connecting the edges of the cut film of FIG. 6 according to a modification.

A second embodiment of the present invention is described below with reference to FIGS. 6, 7, and 8.

Color frames composing each color frame unit (U) have the transfer starting mark in the first embodiment, while in the second embodiment a transfer starting mark 9 is formed in the transfer starting point of each color frame unit (U), namely, in only the transfer starting point of the yellow frame (Y).

Figure 6:
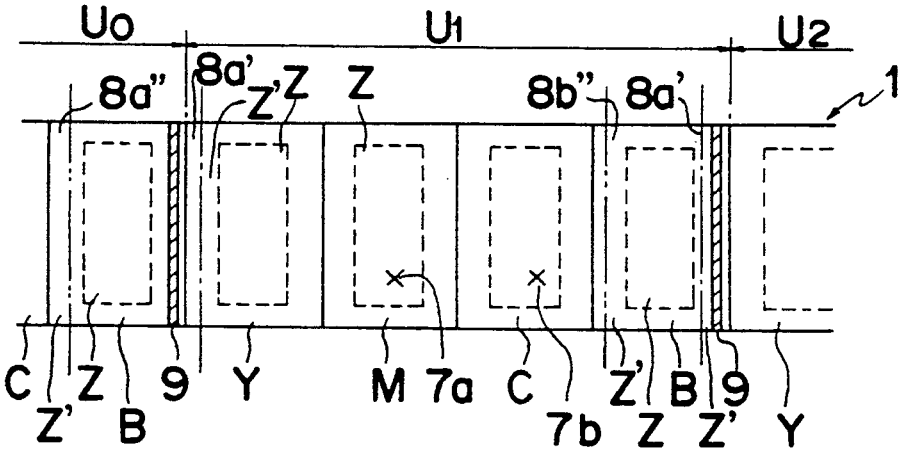
FIG. 6 is a plan view showing the cutting process to be carried out to connect the cut edge of a precedent part of a film and that of a succeeding part thereof with each other according to a second embodiment of the present invention.

FIG. 6 shows a film in which one color frame unit U1 becomes defective at portions 7*a* of the magenta frame (M) and 7*b* of the cyan frame (C). Cutting lines for removing the defective magenta frame (M) and the cyan frame (C) are shown by one-dot chain lines. Cutting lines according to a modification are shown by two-dot chain lines.

The method for cutting the film along the one-dot chain line is described below.

In the first process, the film is cut in a transfer ineffective region (Z') precedent to a transfer effective region (Z) of the yellow frame (Y) precedent to the defective color frames (M) and (C) of the unit U1. FIG. 6 shows the film cut in the region precedent to the transfer effective region (Z) of the yellow frame (Y), but it is possible to cut it in the region succeeding the transfer effective region (Z) of the yellow frame (Y).

In the second process, the film is cut in the transfer ineffective region (Z') rearward of the cyan frame (C) as well as the transfer effective region (Z) of the black frame (B) of the unit U1, namely, the color frame having the same color as that of the final frame of the precedent frame U0. As shown in FIG. 6, the film is cut between the transfer starting mark 9 in the vicinity of the rearmost end of the unit U1 and the transfer effective region (Z) of the black frame (B). Thus, the defective frames (M) and (C) are removed from the film.

In the third process, after the defective color frames (M) and (C) are removed from the film, both edges 8*a*' and 8*b*' thereof are connected with each other with the adhering tape 6 similarly to the first embodiment. As shown in FIG. 7, of the two transfer starting marks 9 adjacent to each other in the adhering region, the precedent mark 9 is covered with the adhering tape 6 so as to destroy it. Therefore, the detecting device of the printer does not read the precedent mark 9. That is, after the image of black frame (B) of the unit U0 is transferred to the printing sheet, the detecting device of the printer does not read anything until it detects the succeeding mark 9.

The film may be cut at positions shown by two-dot chain lines shown in FIG. 6 in addition to the above example in which the film is cut in the yellow frame (Y) of the unit U1 and then, the mark 9 formed on the region backward of the black frame (B) of the unit UO is covered with the adhering tape 6.

That is, in the first process of this modification, the film is cut in the transfer ineffective region (Z') forward of the transfer effective region (Z) of the black frame (B) of the unit U0 precedent to the yellow frame (Y) of the unit U1 precedent to the defective color frame (M).

In the second process, the film is cut in the transfer ineffective region (Z') forward of the transfer effective region (Z) of the black frame (B) of the unit U1 succeeding the defective cyan frame (C).

In the third process, after the defective color frames (M) and (C) are removed from the film, both cut edges 8*a*'' and 8*b*'' of the film are connected with each other with the adhering tape 6 similarly to the first and second embodiments.

In this modification, each of the two cutting positions is disposed at the corresponding position in the color frame of the same color. Thus, the film is wasted in a small amount. In addition, since the mark 9 of the black frame (B) of the unit U0 is removed from the film in the cutting process, it is unnecessary to cover the mark with the adhering tape, unlike the second embodiment.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A method of repairing a thermosensitive transfer film having a plurality of color frame units, each color frame unit comprising at least a yellow frame, a magenta frame and a cyan frame arranged in a straight line in the order of the yellow frame, the magenta frame and the cyan frame, each frame having a transfer starting mark, and one of the frames having a defect, said method comprising the steps of:

cutting the thermosensitive transfer film at a position thereon of a frame having no defect forward of the frame having a defect so that the transfer starting mark of the frame having no defect is broken;

cutting the thermosensitive transfer film at a position rearward of the frame having a defect and forward of the transfer starting mark of a succeeding frame having the same color as the frame having no defect so as to remove the frame having a defect from the thermosensitive transfer film; and connecting both of the cut edges of the thermosensitive transfer film with each other by adhering both of the cut edges to each other with an adhesive tape applied to an ink applied surface of the thermosensitive transfer film such that the cut edge of the forward part of the film is placed on the cut edge of the succeeding part.

2. The method of claim 1, wherein said step of connecting further comprises forming a slight gap between the edges of the adhesive tape and the edges of the film in the width direction of the film.

3. A method of repairing a thermosensitive transfer film having a plurality of color frame units, each color frame unit comprising at least a yellow frame, a magenta frame and a cyan frame arranged in a straight line in the order of the yellow frame, the magenta frame and the cyan frame, each frame having a transfer starting mark, and one of the frames having a defect, said method comprising the steps of:

cutting the thermosensitive transfer film at a position thereon of a frame having no defect forward of the frame having a defect so that the transfer starting mark of the frame having no defect is broken;

cutting the thermosensitive transfer film at a position rearward of the frame having a defect and forward of the transfer starting mark of a succeeding frame having the same color as the frame having no defect so as to remove the frame having a defect from the thermosensitive transfer film; and connecting both of the cut edges of the thermosensitive transfer film with each other so as to maintain the transfer starting mark of the succeeding frame.

4. A method of repairing a thermosensitive transfer film having a plurality of color frame units, each color frame unit comprising at least a yellow frame, a magenta frame and a cyan frame arranged in a straight line in the order of the yellow frame, the magenta frame and the cyan frame, one of the frames having a defect, and each color frame unit having a transfer starting mark provided in a transfer ineffective region forward of a transfer effective region of the yellow frame of the color frame unit, said method comprising the steps of:

cutting the film in a transfer ineffective region either forward or rearward of a corresponding transfer effective region of a frame having no defect forward of the frame having a defect;

cutting the film in a transfer ineffective region rearward of a corresponding transfer effective region of a frame having the same color as the rearward most frame of the film cut forward of the frame having a defect rearward of the frame having a defect so as to remove the frame having a defect from the film;

connecting both of the cut edges of the thermosensitive transfer film with each other by adhering both of the cut edges to each other with an adhesive tape applied to an ink applied surface of the thermosensitive transfer film such that the cut edge of the forward part of the film is placed on the cut edge of the succeeding part to a small extent.

5. The method of claim 4, wherein said step of connecting further comprises forming a slight gap between the edges of the adhesive tape and the edges of the film in the width direction of the film.

6. A method of repairing a thermosensitive transfer film having a plurality of color frame units, each color frame unit comprising at least a yellow frame, a magenta frame and a cyan frame arranged in a straight line in the order of the yellow frame, the magenta frame and the cyan frame, one of the frames having a defect, and each color frame unit having a transfer starting mark provided in a transfer ineffective region forward of a transfer effective region of the yellow frame of the color frame unit, said method comprising the steps of:

cutting the film in a transfer ineffective region either forward or rearward of a corresponding transfer effective region of a frame having no defect forward of the frame having a defect;

cutting the film in a transfer ineffective region rearward of a corresponding transfer effective region of a frame having the same color as the rearward most frame of the film cut forward of the frame having a defect rearward of the frame having a defect so as to remove the frame having a defect from the film;

connecting both of the cut edges of the film with each other; and covering a forward transfer starting mark with adhesive tape if two transfer starting marks are placed adjacent to each other in said step of connecting.

7. A thermosensitive transfer film for use in color printing, comprising:

a plurality of color frame units, each said color frame unit comprising at least a yellow frame, a magenta frame and a cyan frame arranged in a straight line in the order of said yellow frame, said magenta frame and said cyan frame, and each said frame having a transfer starting mark;

a first cut through said film forming a first cut edge such that a said transfer starting mark of a said frame through which said first cut extends is broken;

a second cut through said film forming a second cut edge, said second cut extending through a said frame forward of the said transfer starting mark of the succeeding said color frame, the succeeding said color frame having the same color as said frame through which said first cut extends; and a connection connecting both said cut edges with each other.

8. The film of claim 7, wherein said film has one surface thereof with ink applied thereto, said connection comprises adhesive tape on said one surface of said film and said first cut edge overlaps said second cut edge.

9. The film of claim 8 wherein said adhesive tape extends across the width of said film, with a gap being formed between the edges of said adhesive tape and the edges of said film.

10. A thermosensitive transfer film for use in color printing, comprising:

a plurality of color frame units, each said color frame unit comprising at least a yellow frame, a magenta frame and a cyan frame arranged in a straight line in the order of said yellow frame, said magenta frame and said cyan frame, each said frame having a transfer effective region and a transfer ineffective region, and each said color frame unit having a transfer starting mark in said transfer ineffective region of said yellow frame thereof forward of said transfer effective region;

a first cut through said film forming a first cut edge in a transfer ineffective region of a said frame of a said color frame unit;

a second cut through said film forming a second cut edge said second cut extending through a said transfer ineffective region of a said color frame rearwardly of said transfer effective region of the said color frame, the said color frame having had the same color as the color of the last said color frame preceding said first cut edge; and a connection connecting both said cut edges with each other.

11. The film of claim 10, wherein each said cut edge has a respective said transfer starting mark adjacent thereto, one of said transfer starting marks being covered by adhesive tape.

12. The film of claim 10, wherein said film has one surface thereof with ink applied thereto, said connection comprises adhesive tape on said one surface of said film and said first cut edge overlaps said second cut edge.

13. The film of claim 12 wherein said adhesive tape extends across the width of said film, with a gap being formed between the edges of said adhesive tape and the edges of said film.

14. The film of claim 12, wherein each said cut edge has a respective said transfer starting mark adjacent thereto, one of said transfer starting marks being covered by said adhesive tape.

* * * * *